US010049606B2

(12) United States Patent
Lin et al.

(10) Patent No.: US 10,049,606 B2
(45) Date of Patent: Aug. 14, 2018

(54) GATE DRIVER AND METHOD FOR ADJUSTING OUTPUT CHANNELS THEREOF

(71) Applicant: Novatek Microelectronics Corp., Hsinchu (TW)

(72) Inventors: Ting-Chun Lin, Hsinchu County (TW); Shu-Wei Chang, New Taipei (TW); Chiu-Hung Cheng, Hsinchu (TW); Chih-Kai Yu, Miaoli County (TW)

(73) Assignee: Novatek Microelectronics Corp., Hsinchu (TW)

( * ) Notice: Subject to any disclaimer, the term of this patent is extended or adjusted under 35 U.S.C. 154(b) by 2 days.

(21) Appl. No.: 14/842,844

(22) Filed: Sep. 2, 2015

(65) Prior Publication Data

US 2017/0011705 A1 Jan. 12, 2017

Related U.S. Application Data

(60) Provisional application No. 62/190,273, filed on Jul. 9, 2015.

(51) Int. Cl.
*G09G 3/20* (2006.01)

(52) U.S. Cl.
CPC ..... *G09G 3/20* (2013.01); *G09G 2310/0213* (2013.01); *G09G 2310/0267* (2013.01); *G09G 2310/08* (2013.01); *G09G 2330/022* (2013.01)

(58) Field of Classification Search
None
See application file for complete search history.

(56) References Cited

U.S. PATENT DOCUMENTS

| | | | | |
|---|---|---|---|---|
| 7,649,579 | B2 | 1/2010 | Kang | |
| 8,319,931 | B2 | 11/2012 | Chen et al. | |
| 8,325,119 | B2 | 12/2012 | Yi | |
| 2004/0169631 | A1* | 9/2004 | Tanaka | G09G 5/006 345/96 |
| 2006/0290646 | A1 | 12/2006 | Kang | |
| 2007/0182876 | A1 | 8/2007 | Chen et al. | |
| 2008/0204391 | A1 | 8/2008 | Yi | |

(Continued)

FOREIGN PATENT DOCUMENTS

| | | |
|---|---|---|
| CN | 104700796 | 6/2015 |
| TW | I334590 | 12/2010 |

(Continued)

OTHER PUBLICATIONS

"Office Action of Taiwan Counterpart Application" , dated Aug. 1, 2016, p. 1-p. 5.

*Primary Examiner* — Joseph Haley
(74) *Attorney, Agent, or Firm* — JCIPRNET

(57) ABSTRACT

A gate driver and a method for adjusting output channels thereof are provided. The method includes: setting a target number of the output channels; dividing the output channels into a first channel chain and a second channel chain; enabling a scanning operation of the first channel chain according to a clock signal and counting the clock signal to obtain a counting value; and when the counting value reaching a threshold value, enabling a scanning operation of the second channel chain, wherein the threshold value is determined according to a difference value between the target number and the physical number.

16 Claims, 5 Drawing Sheets

(56) References Cited

U.S. PATENT DOCUMENTS

| | | | | |
|---|---|---|---|---|
| 2008/0211794 | A1 | 9/2008 | Yi et al. | |
| 2010/0188375 | A1* | 7/2010 | Lee | G09G 3/3266 345/204 |
| 2013/0249872 | A1* | 9/2013 | Kang | G09G 3/3677 345/204 |
| 2014/0002424 | A1* | 1/2014 | Lee | G09G 3/3266 345/204 |
| 2015/0116009 | A1 | 4/2015 | Choi | |
| 2015/0161956 | A1 | 6/2015 | Lee et al. | |

FOREIGN PATENT DOCUMENTS

| | | |
|---|---|---|
| TW | I349247 | 9/2011 |
| TW | I350515 | 10/2011 |
| TW | I382388 | 1/2013 |
| TW | I396176 | 5/2013 |

* cited by examiner

GATE DRIVER AND METHOD FOR ADJUSTING OUTPUT CHANNELS THEREOF

CROSS-REFERENCE TO RELATED APPLICATION

This application claims the priority benefits of U.S. provisional application Ser. No. 62/190,273, filed on Jul. 9, 2015. The entirety of the above-mentioned patent application is hereby incorporated by reference herein and made a part of this specification.

BACKGROUND

Field of the Invention

The invention is directed to a gate driver for a display apparatus and more particularly, to a method for adjusting the number of output channels of the gate driver.

Description of Related Art

In recently years, electronic apparatus are more important for human's life. A high performance display apparatus is an important part in the electronic apparatus. For satisfying display panels with several display resolutions, the number of output channels of the gate driver of the display apparatus must be adjustable.

In conventional art, a plurality of switching units are embedded in the gate diver for adjusting the number of the output channels of the gate driver. For example, in a gate driver with 640 physical channels, for adjusting the number of the output channels 6 to 640, 634 switching units are needed in the gate driver. That is, a large chip area is needed for the switching units and transmission lines, and cost is increased correspondingly.

SUMMARY

The invention provides a gate driver and a method for adjusting a number of the output channels flexibly.

The invention is directed to the method for adjusting output channels of a gate driver. The method includes: setting a target number of the output channels; dividing the output channels into a first channel chain and a second channel chain; enabling a scanning operation of the first channel chain according to a clock signal and counting the clock signal to obtain a counting value; and when the counting value reaching a threshold value, enabling a scanning operation of the second channel chain, wherein the threshold value is determined according to a difference value between the target number and the physical number, and is smaller than the physical number.

In an embodiment of the invention, wherein the threshold value equals to one half of the physical number subtracting the difference value.

In an embodiment of the invention, wherein THV=(PN/2−DV) when the target number is an even number, wherein the THV is the threshold value, the PN is the physical number, and the DV is the difference value.

In an embodiment of the invention, wherein THV=(PN/2−DV−1) when the target number is an odd number, wherein the THV is the threshold value, the PN is the physical number, and the DV is the difference value.

In an embodiment of the invention, wherein steps of enabling the scanning operation of the first channel chain according to the clock signal includes: sending a start pulse signal to a first channel of the first channel chain for enabling the scanning operation of the first channel chain; and respectively enabling output signals of channels of the first channel chain one by one according to the clock signal.

In an embodiment of the invention, wherein when the counting value reaching the threshold value, a start pulse signal is transmitted to a first channel of the second channel chain for enabling the scanning operation of the second channel chain.

In an embodiment of the invention, wherein the first channel chain comprises a plurality of first scanning channels and a plurality of first dummy channels which are arranged in sequence, and the second channel chain comprises a plurality of second dummy channels and a plurality of second scanning channels which are arranged in sequence.

In an embodiment of the invention, wherein a first channel of the second dummy channels receives a start pulse signal for enabling the scanning operation of the second channel chain when the counting value reaching the threshold value.

In an embodiment of the invention, wherein when the target number is an even number, the number of the output channels of the first channel chain is A, and the number of the output channels of the second channel chain is B. When the target number is an odd number, the number of the output channels of the first channel chain is A−1, and the number of the output channels of the second channel chain is B+1. Both of A and B are positive integers.

The present invention also provides a gate driver. The gate driver includes a plurality of output channels and a controller. The output channels are divided into a first channel chain and a second channel chain. The controller is coupled to the output channels. The controller receives an option signal to set a target number of the output channels and enable a scanning operation of the first channel chain according to a clock signal. The controller also counts the clock signal to obtain a counting value. Furthermore, when the counting value reaching a threshold value, the controller enables a scanning operation of the second channel chain, wherein the threshold value is determined according to a difference value between the target number and the physical number.

To sum up, the gate driver of the invention provides a counting scheme when the scanning operation of the first channel chain is operated. Furthermore, by enabling a scanning operation of the second channel chain when the counting value reaching a threshold value, the number of the output channels of the gate driver can be adjusted. That is, the number of switching units can be reduced, and chip size of the gate driver can be reduced. The cost and power consumption of the gate driver can be reduced.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
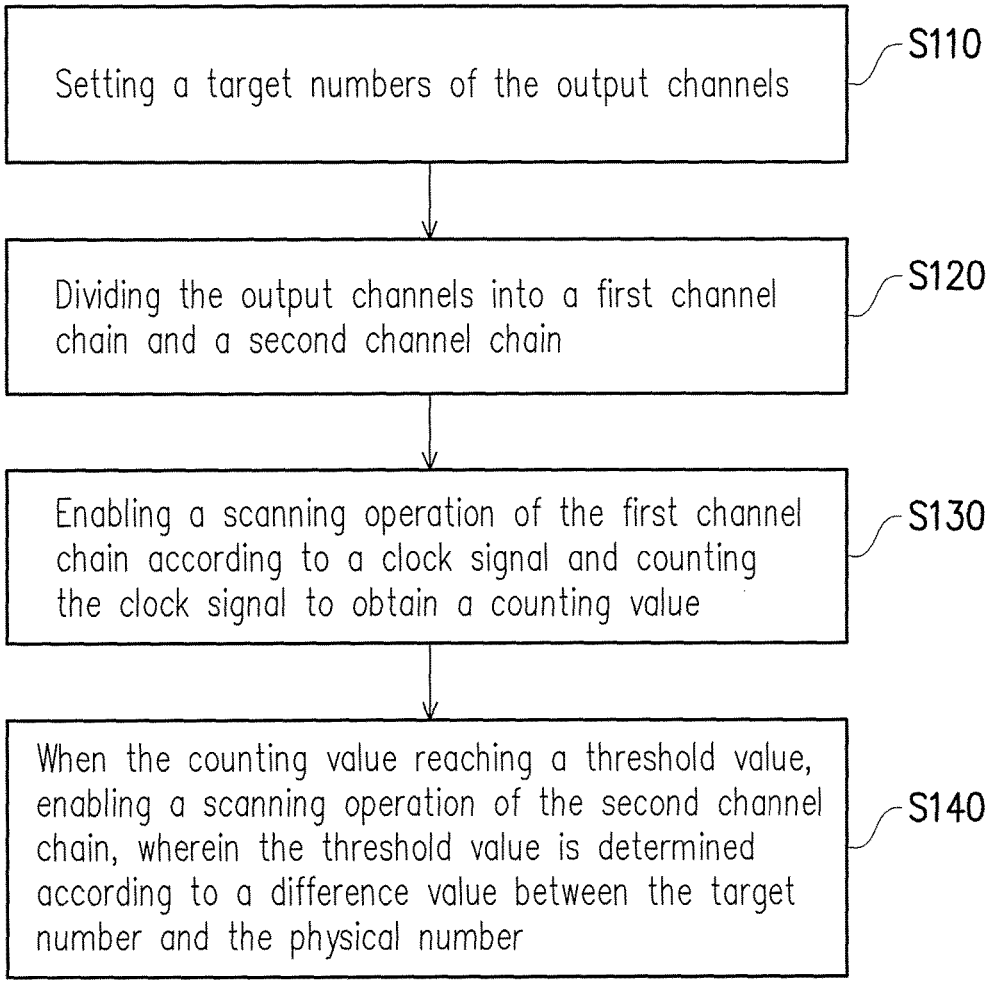
FIG. 1 illustrates a flow chart of a method for adjusting output channels of a gate driver according to an embodiment of present application.

Referring to FIG. 1, FIG. 1 illustrates a flow chart of a method for adjusting output channels of a gate driver according to an embodiment of present application. In this embodiment, the gate driver has a plurality of physical output channels. In step S110, a target number of the output channels is set, and the target number may be smaller than a physical number of the output channels. By applying the gate driver to a display panel, the target number of the output channels is adjusted according to a number of scan lines of the display panel. That is, when the scan lines of the display panel is determined, the target number of the output channel can be set by executing the step S110. On the other hand, the gate driver of presented disclosure can be applied to a plurality of display panels with different scan lines, and the step S110 can be executed again for updating the target number of the output channel of the gate driver.

In step S120, all of the output channels of the gate driver can be divided into a first channel chain and a second channel chain, wherein each of the first and second channel chains includes a plurality of output channels of the gate driver. Furthermore, along a scan direction of the gate driver, the first output channel chain is arranged before the second output channel chain.

After the step S120 have been executed, a scanning operation of the gate driver can be executed. In step S130, the scanning operation of the first channel chain is enabled, and the scanning operation of the first channel chain is executed according to a clock signal. In detail, the scanning operation of the first channel chain may be enabled by a start pulse signal, and the output channels of the first channel chain are respectively enabled one by one according to the clock signal. When each of the output channels of the first channel chain is enabled, the enabled output channel of the first channel chain generates an output signal with a high voltage level, and when each of the output channels of the first channel chain is not enabled, the disabled output channel of the first channel chain generates the output signal with a low voltage level. On the other hand, in the step S130, the clock signal is also counted while the scanning operation is operated and a counting value is obtained correspondingly.

In the step S140, the counting value may be increased from 0 according to the clock signal. The counting value is compared with a threshold value, and when the counting value reaches to (equals to) the threshold value, the other scanning operation of the second channel chain can be enabled. The threshold value is smaller than the number of the output channels of the first channel chain. Moreover, the threshold value may be determined according to a difference value of the target number and the physical number of the output channels.

In detail, when the counting value reaches to the threshold value, the start pulse signal is transmitted to a first output channel of the second channel chain and the scanning operation of the second channel chain can be started. It can be seen easily, the scanning operation of the second channel chain is started in advance. At this time, the scanning operation of the first channel chain keeps on operating. That is, there is a time period in which the scanning operations of both of the first and second channel chains can be operated simultaneously. During the time period, some of the output signals generated by the first or second channel chains are not applied to the display panel, and the output channels applied to the display panel can be adjusted.

Figure 2:
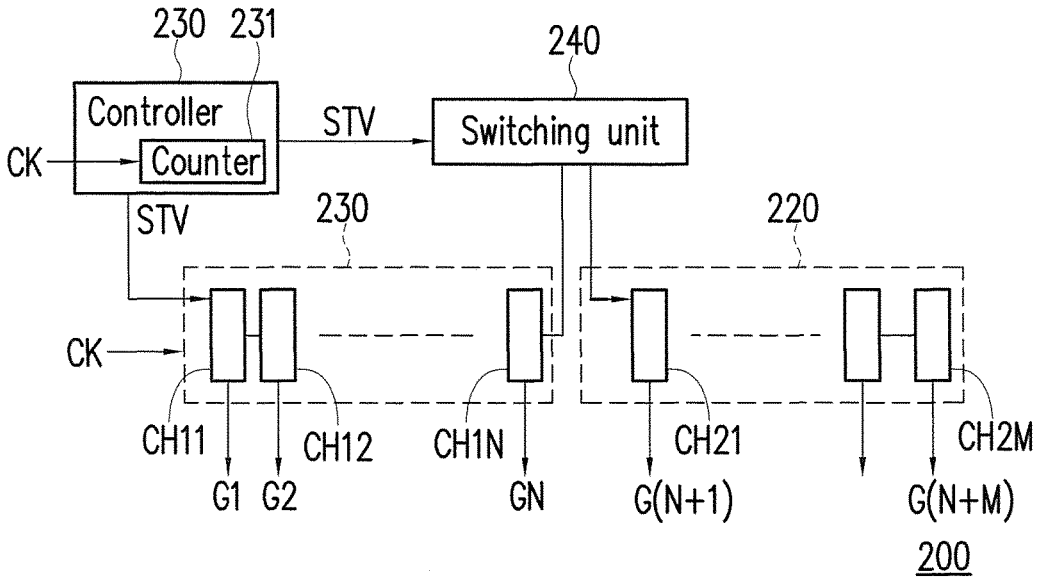
FIG. 2 illustrates a schematic plot of a gate driver according to an embodiment of present application.

Referring to FIG. 2, FIG. 2 illustrates a schematic plot of a gate driver according to an embodiment of present application. The gate driver 200 includes a first channel chain 210, a second channel chain 220, a controller 230 and a switching unit 240. The first channel chain 210 includes a plurality of output channels CH11-CH1N, and the second channel chain 220 includes a plurality of output channels CH21-CH2M. The controller 230 is coupled to the first channel chain 210 and the switching unit 240. The controller 230 includes a counter 231. The controller 230 may send a start pulse signal STV to the first output channel CH11 of the first channel chain 210 and the switching unit 240 at different time points.

In detail operation of the gate driver 200, the start pulse signal STV is transmitted to the first output channel CH11 of the first channel chain 210 by the controller 230, and the scanning operation of the first channel chain 210 can be started. The first output channel CH11 may enable an output signal G1 according to the clock signal CK. Then, the output signal G1 may be fed to the next output channel CH12 of the first channel chain 210 to be a start signal of the output channel CH12, and the output channel CH12 may enable another output signal G2 during a next period of the clock signal CK. That is, the output signals G1-GN of the first channel chain 210 may be enabled one by one according to the clock signal CK.

The start pulse signal STV is transmitted to the first output channel CH21 of the second channel chain 220 by the controller 230 at another time point, and the scanning operation of the first channel chain 220 can be started. The first output channel CH21 may enable an output signal G(N+1) according to the clock signal CK. Then, the output signal G(N+1) may be fed to the next output channel of the second channel chain 220 to be a start signal thereof, and the output channel may enable another output signal during a next period of the clock signal CK. That is, the output signals G(N+1)–G(N+M) of the second channel chain 220 may be enabled one by one according to the clock signal CK.

The switching unit 240 is used to determine to transmit the start pulse signal STV or the output signal GN to the first output channel CH21 of the second channel chain 220. If the output channel of the gate driver 200 is adjusted, the switching unit 240 transmits the start pulse signal STV to the first output channel CH21 of the second channel chain 220, and blocks the output signal GN to transmit to the first output channel CH21 of the second channel chain 220. On the contrary, if the output channel of the gate driver 200 is not adjusted, the switching unit 240 blocks the start pulse signal STV to the first output channel CH21 of the second channel chain 220, and transmits the output signal GN to transmit to the first output channel CH21 of the second channel chain 220.

Figure 3:
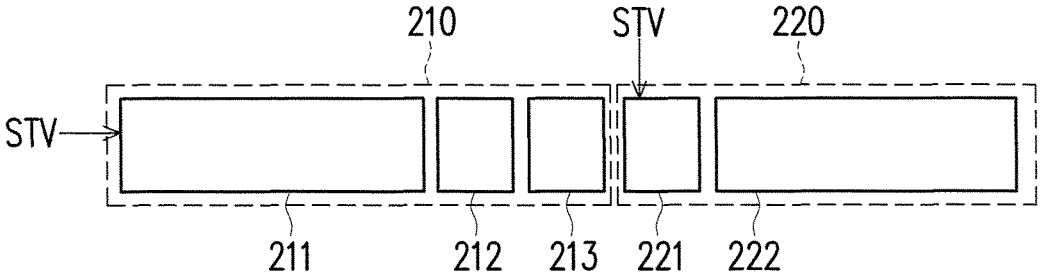
FIG. 3 illustrates a block diagram of the output channel of the gate driver according to an embodiment of present application.

Referring to FIG. 2 and FIG. 3, wherein FIG. 3 illustrates a block diagram of the output channels of the gate driver according to an embodiment of present application. It should be noted here, in FIG. 3, the first channel chain 210 may be divided into three parts 211-213. The first and second parts 211-212 of the first channel chain 210 include a plurality of scanning channels, and the third part 213 of the first channel chain 210 includes at least one dummy channel. The scanning channels and the at least one dummy channel are arranged in sequence along a scanning direction of the gate driver 200. Wherein, the at least one dummy channel may not be applied to the display panel, and the scanning channels are applied to the display panel. Moreover, the second channel chain 220 may be divided into two parts 221-222.

The first parts 221 of the second channel chain 220 includes at least one dummy channel, and the second part 222 of the second channel chain 220 includes a plurality of scanning channels. The scanning channels and the at least one dummy channel in the second channel chain 220 are arranged in sequence along a scanning direction of the gate driver 200. Wherein, the at least one dummy channel may not applied to the display panel, and the scanning channels are applied to the display panel. The dummy channel and the scanning channels in the second channel chain 220 are arranged in sequence along a scanning direction of the gate driver 200.

During the scanning operation of the first channel chain 210 is operated, the counter 231 counts the clock signal CK to obtain a counting value. The controller 230 compares a threshold value and the counting value, and when the counting value reaching the threshold value, the controller 230 transmits the start pulse signal STV to the switching unit 240, and the switching unit 240 passes the start pulse signal STV to the second channel chain 220 to enable a scanning operation of the second channel chain 220.

In FIG. 3, for example, when the scanning operation in the part 211 of the first channel chain is completely, the counting value reaches to the threshold value, and the start pulse signal STV is transmitted to the first channel CH21 of the first part 221 of the second channel chain 220. Then, two scanning operations are operated simultaneously on the second part 212 of the first channel chain 210 and the first part 221 of the second channel chain 220. In here, the number of the output channels in the second part 212 and the first part 221 are the same, and output signals of the second part 212 and the first part 221 may be generated simultaneously. That is, by applying the output signals generated by the output channels (scanning channels) of the second part 212 to the display panel, and discarding the output signals generated by the output channels (dummy channels) of the second part 212, the effective output channels of the gate driver 200 can be adjusted.

After the scanning operation in the second part 212 of the first channel chain 210 has been completed, the scanning operation is operated on the third part 213 of the first channel chain 210, and another scanning operation is operated on the second part 222 of the second channel chain 220. The output signals generated by the third part 213 of the first channel chain 210 may be discarded, and not applied to the display panel, and the effective output channels of the gate driver 200 can be further adjusted.

It should be noted here, the threshold value may be determined according to the difference value between the target number and the physical number. In one embodiment of present application, the threshold value THV may equal to one half of the physical number (PN/2) subtracts the difference value (DV) when the target number is an even number, wherein, PN is the physical number and DV is the difference value. For example, if the physical number of the output channels is 640, the target number of the output channels is 600, the threshold value THV is (640/2) −(640-600) =320−40=280.

On the other hand, when the target number is an odd number, the threshold value THV =(PN/2−DV−1). For example, if the physical number of the output channels is 640 and the target number of the output channels is 619, the threshold value THV =(640/2−(640-619)−1) =320−21−1 =298.

It can be easily seen, there is a relationship between the physical number, the target number and the threshold value. The relationship may be carried out by a lookup table. The lookup table may be embedded in the controller 231 or external from the controller 231, and the controller 231 may obtain the threshold value according to the lookup table mentioned above.

Figure 4A:
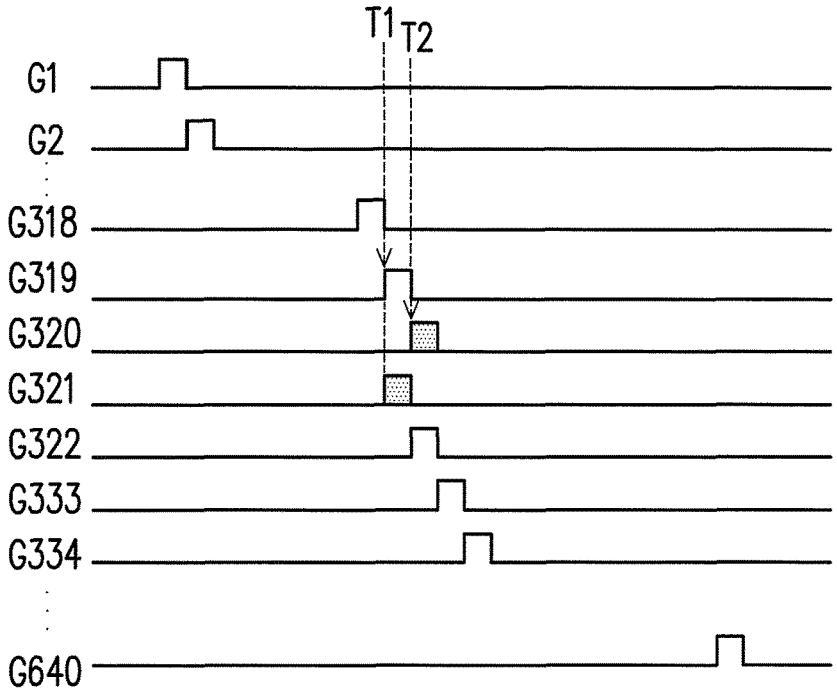
FIG. 4A-FIG. 4C illustrate waveform plots of the output signals of the gate driver according to an embodiment of present application.
Figure 4B:
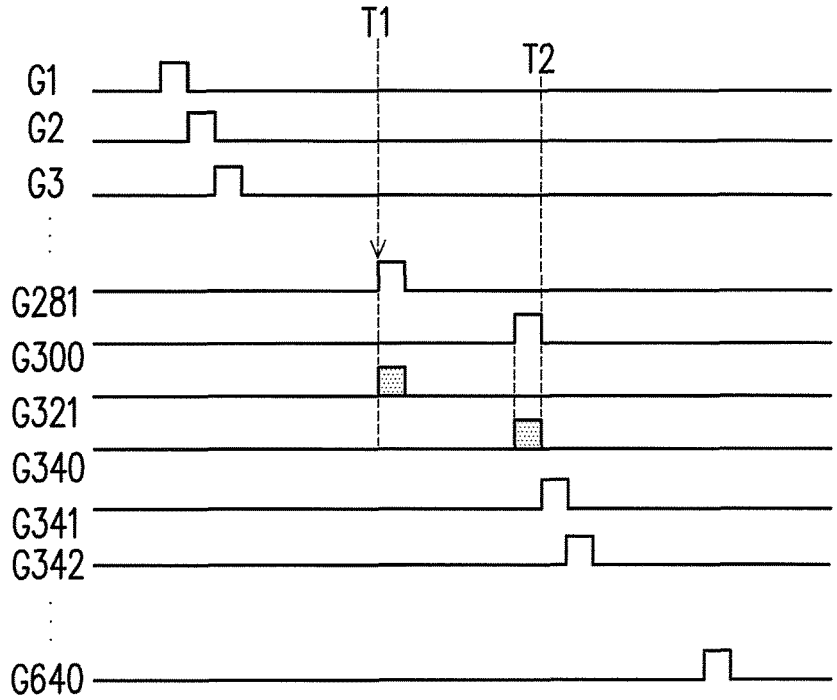
Figure 4C:
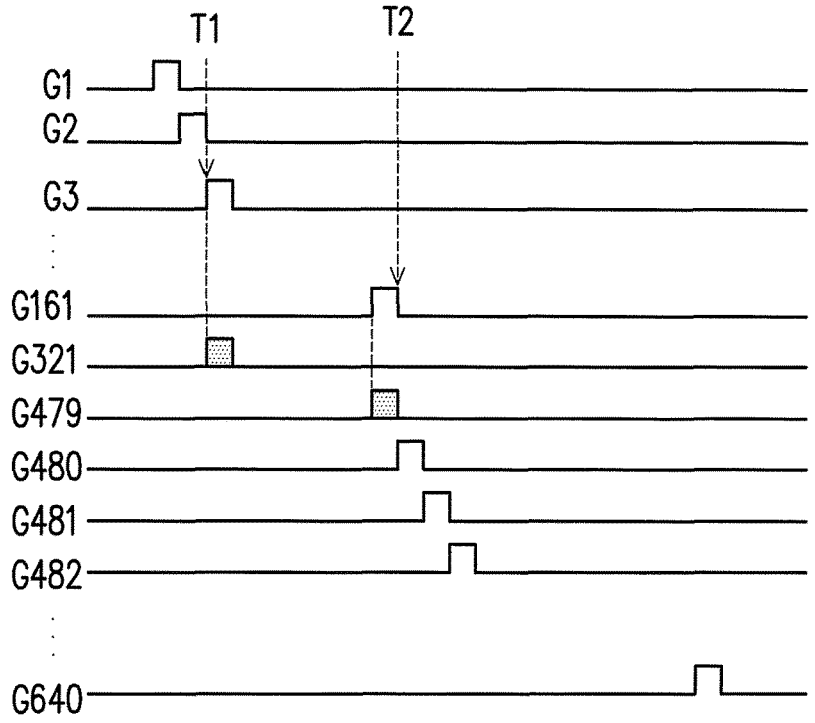

Referring to FIG. 4A-FIG. 4C, FIG. 4A-FIG. 4C illustrate waveform plots of the output signals of the gate driver according to an embodiment of present application. In FIG. 4A, the first channel chain is used to generate the output signals G1-G320, and the second channel chain is used to generate output signals G321-G640. The physical number is 640 and the target number is set to 638. The different value is 640−638=2, and the threshold value=640/2−2=318. At time point T1, the counting value reaches to the threshold value, a start pulse signal is transmitted to the first channel of the second channel chain, and a scanning operation of the second channel chain is started. Then, during the time period between the time points T1 and T2, the output signals G319 and G321 are enabled simultaneously, and the output signal G319 is generated by a dummy channel and should be discarded. After the time point T2, the output signals G320 and G322 are enabled simultaneously, and the output signal G320 is generated by a dummy channel and should be discarded. Such as that, the effective output channels of the gate driver is adjusted to 638.

In FIG. 4B, the first channel chain is used to generate the output signals G1-G320, and the second channel chain is used to generate output signals G321-G640. The physical number is 640 and the target number is set to 600. The different value is 640−600=40, and the threshold value=640/2−40=280. At time point T1, the counting value reaches to the threshold value, a start pulse signal is transmitted to the first channel of the second channel chain, and a scanning operation of the second channel chain is started. Then, during the time period between the time points T1 and T2, the output signals G321 to G340 are enabled simultaneously, and the output signals G321-G340 are generated by dummy channels and should be discarded. After the time point T2, the output signals G301-G320 and G341-G360 are enabled simultaneously, and the output signals G301-G320 are generated by dummy channels and should be discarded. Such as that, the effective output channels of the gate driver is adjusted to 600.

In FIG. 4C, the first channel chain is used to generate the output signals G1-G320, and the second channel chain is used to generate output signals G321-G640. The physical number is 640 and the target number is set to 322. The different value is 640−322=318, and the threshold value=640/2−318=2. At time point T1, the counting value reaches to the threshold value, a start pulse signal is transmitted to the first channel of the second channel chain, and a scanning operation of the second channel chain is started. Then, during the time period between the time points T1 and T2, the output signals G321 to G479 are enabled simultaneously, and the output signals G321-G479 are generated by dummy channels and should be discarded. After the time point T2, the output signals G162-G320 and G480-G638 are enabled simultaneously, and the output signals G162-G320 are generated by dummy channels and should be discarded. Such as that, the effective output channels of the gate driver is adjusted to 322.

Figure 5A:
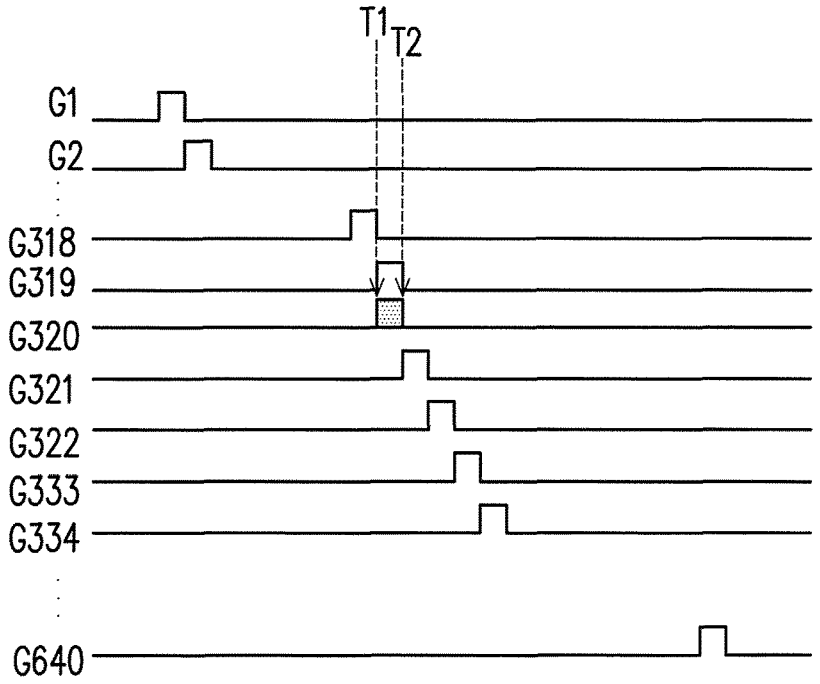
FIG. 5A-FIG. 5B illustrate waveform plots of the output signals of the gate driver according to another embodiment of present application.
Figure 5B:
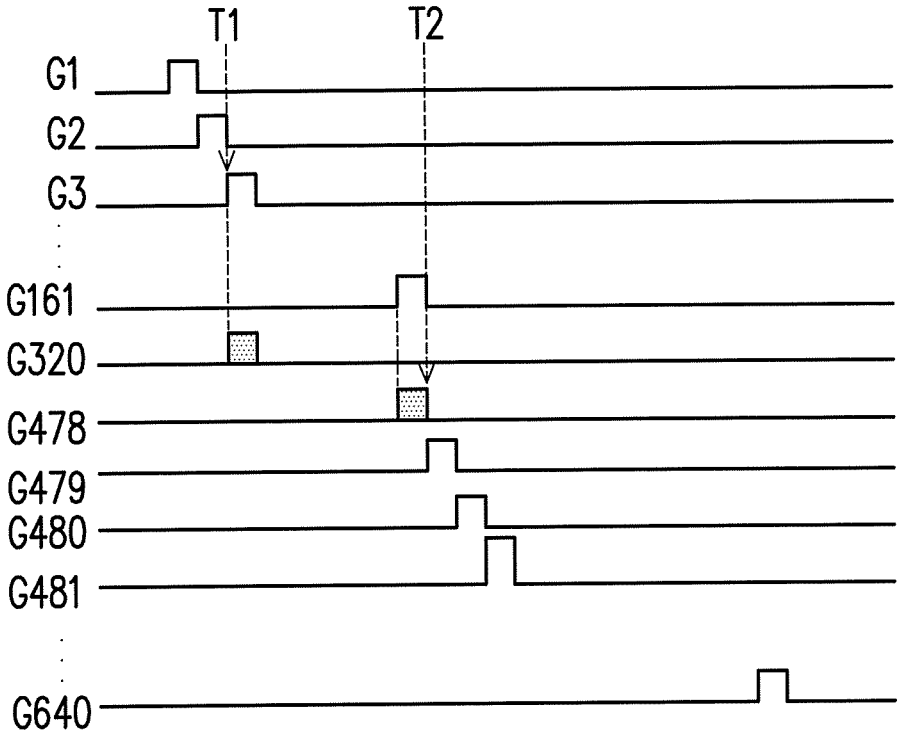

Referring to FIG. 5A-FIG. 5B, FIG. 5A-FIG. 5B illustrate waveform plots of the output signals of the gate driver according to another embodiment of present application. In FIG. 5A, the first channel chain is used to generate the output signals G1-G319, and the second channel chain is used to generate output signals G320-G640. The physical number is 640 and the target number is set to 639. The different value is 640−639=1, and the threshold value=640/2−1−1=318. At time point T1, the counting value reaches to the threshold value, a start pulse signal is transmitted to the first channel of the second channel chain, and a scanning operation of the second channel chain is started. Then, during the time period between the time points T1 and T2, the output signal G320 is enabled, and the output signal G320 is generated by a dummy channel and should be discarded. Such as that, the effective output channels of the gate driver is adjusted to 639.

In FIG. 5B, the first channel chain is used to generate the output signals G1-G319, and the second channel chain is used to generate output signals G320-G640. The physical number is 640 and the target number is set to 323. The different value is 640−323=317, and the threshold value=640/2−317−1=2. At time point T1, the counting value reaches to the threshold value, a start pulse signal is transmitted to the first channel of the second channel chain, and a scanning operation of the second channel chain is started. Then, during the time period between the time points T1 and T2, the output signals G320-G478 are enabled, and the output signals G320-G478 are generated by dummy channels and should be discarded. After the time point T2, the output signals G162-G319 and G479-G636 are enabled simultaneously, and the output signals G162-G319 are generated by dummy channels and should be discarded. Such as that, the effective output channels of the gate driver is adjusted to 317.

It should be noted here, the numbers of the output channels of the first and second channel chains are not fixed. For example, in a gate driver with 640 physical output channels, the numbers of channels of the first channel chain may be set to 320, 480, 560, 600, 620, 630 or 635 when the target number is set to an even number, and the numbers of channels of the second channel chain may respectively be set to 320, 160, 40, 20, 10 or 5. The numbers of channels of the first and second channel chains are the same. On the other hand, when the target number is set to an odd number, the numbers of channels of the first channel chain may be set to 319, 479, 559, 599, 619, 629 or 634, and the numbers of channels of the second channel chain may respectively be set to 321, 161, 41, 21, 11 or 6. However, the numbers of channels of the first channel chain is larger than the threshold value.

To conclude, in the present application, the effective output channels of the gate driver can be adjusted within a wide range. Moreover, when only some switching units are needed in the gate driver, the chips size of the gate driver is not increased correspondingly. That is, the cost of the gate driver can be reduced.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A method for adjusting output channels of a gate driver, comprising:

setting a target number for the output channels;

dividing the output channels into a first channel chain and a second channel chain, wherein a total number of the output channels of the first channel chain and the output channels of the second channel chain is equal to a physical number;

enabling a scanning operation of the first channel chain according to a clock signal and obtaining a counting value for counting number of scanning operations of the first channel chain; and when the counting value reaches a threshold value, enabling a scanning operation of the second channel chain such that there is a time period in which the respective scanning operations of a part or all of the output channels of the first channel chain are operated simultaneously with respective scanning operations of a corresponding part or all of the output channels of the second channel chain, wherein the threshold value is determined according to a difference value between the target number and the physical number, wherein a total number of the part or all of the output channels of the first channel chain and the part or all of the output channels of the second channel chain is equal to the target number.

2. The method according to claim 1, wherein THV=(PN/2−DV) when the target number is an even number, wherein the THV is the threshold value, the PN is the physical number, and the DV is the difference value.

3. The method according to claim 1, wherein THV=(PN/2−DV−1) when the target number is an odd number, wherein the THV is the threshold value, the PN is the physical number, and the DV is the difference value.

4. The method according to claim 1, wherein enabling the scanning operation of the first channel chain according to the clock signal comprises:

sending a start pulse signal to a first channel of the first channel chain for enabling the scanning operation of the first channel chain; and respectively enabling output signals of channels of the first channel chain one by one according to the clock signal.

5. The method according to claim 1, wherein when the counting value reaching the threshold value, enabling the scanning operation of the second channel chain comprises:

sending a start pulse signal to a first channel of the second channel chain.

6. The method according to claim 1, wherein the first channel chain comprises a plurality of first scanning channels and at least one first dummy channel which are arranged in sequence, and the second channel chain comprises at least one second dummy channel and a plurality of second scanning channels which are arranged in sequence.

7. The method according to claim 6, wherein a first channel of the second dummy channels receives a start pulse signal for enabling the scanning operation of the second channel chain when the counting value reaching the threshold value.

8. The method according to claim 1, wherein when the target number is an even number, the number of the output channels of the first channel chain is A, and the number of the output channels of the second channel chain is B, and when the target number is an odd number, the number of the output channels of the first channel chain is A−1, and the number of the output channels of the second channel chain is B+1, wherein A and B are positive integers.

9. A gate driver, comprising:

a plurality of output channels, wherein the output channels are divided into a first channel chain and a second channel chain, and a total number of the output channels of the first channel chain and the output channels of the second channel chain is equal to a physical number;

a controller, coupled to the output channels, receiving an option signal for setting a target number for the output channels, enabling a scanning operation of the first channel chain according to a clock signal and obtaining a counting value for counting number of scanning operations of the first channel chain, and when the counting value reaching a threshold value, the controller enabling a scanning operation of the second channel chain such that there is a time period in which the respective scanning operations of a part or all of the output channels of the first channel chain are operated simultaneously with respective scanning operations of a corresponding part or all of the output channels of the second channel chain, wherein the threshold value is determined according to a difference value between the target number and the physical number, wherein a total number of the part or all of the output channels of the first channel chain and the part or all of the output channels of the second channel chain is equal to the target number.

10. The gate driver according to claim 9, wherein the controller comprises a counter, and the counter counts the clock signal to obtain the counting value when the scanning operation of the first channel chain is enabled.

11. The gate driver according to claim 9, further comprising:

a switching unit, coupled to a first channel of the second channel chain, transporting a start pulse signal to the first channel of the second channel chain when the counting value reaches the threshold value.

12. The gate driver according to claim 9, wherein THV=(PN/2−DV) when the target number is an even number, wherein the THV is the threshold value, the PN is the physical number, and the DV is the difference value.

13. The gate driver according to claim 9, wherein THV=(PN/2−DV−1) when the target number is an odd number, wherein the THV is the threshold value, the PN is the physical number, and the DV is the difference value.

14. The gate driver according to claim 9, wherein the controller sends a start pulse signal to a first channel of the first channel chain for enabling the scanning operation of the first channel chain, and sends the start pulse signal to a first channel of the second channel chain for enabling the scanning operation of the second channel chain when the counting value reaching the threshold value.

15. The method according to claim 1, wherein the difference value is obtained by subtracting the target number from the physical number, and the threshold value is obtained by operating a subtracting operation on half of the physical number and the difference number.

16. The gate driver according to claim 9, wherein the difference value is obtained by subtracting the target number from the physical number, and the threshold value is obtained by operating a subtracting operation on half of the physical number and the difference number.

* * * * *